US006142649A

United States Patent [19]

Beghelli

[11] Patent Number: 6,142,649

[45] Date of Patent: Nov. 7, 2000

[54] EMERGENCY LIGHTING FIXTURE, ESPECIALLY FOR INDUSTRIAL ENVIRONMENTS

[75] Inventor: Gian Pietro Beghelli, Monteveglio, Italy

[73] Assignee: Beghelli S.p.A., Monteveglio, Italy

[21] Appl. No.: 09/036,017

[22] Filed: Mar. 6, 1998

[30] Foreign Application Priority Data

Jun. 2, 1997 [IT] Italy ..... MI97A1290

[51] Int. Cl.[7] ..... F21K 27/00

[52] U.S. Cl. ..... 362/259; 362/542

[58] Field of Search ..... 362/259, 228, 362/231, 233, 363, 542, 157, 486; 315/33, 86; 313/1; 340/557, 321, 331

[56] References Cited

U.S. PATENT DOCUMENTS

| | | | |
|---|---|---|---|
| 3,710,098 | 1/1973 | Walden | 362/259 |
| 4,353,110 | 10/1982 | Ellis | 362/231 |
| 4,617,561 | 10/1986 | Brown | 340/628 |
| 5,565,839 | 10/1996 | Poss | 340/321 |
| 5,629,105 | 5/1997 | Matthews | 362/184 |
| 5,871,272 | 2/1999 | Sharrah | 362/228 |

FOREIGN PATENT DOCUMENTS

| | | |
|---|---|---|
| 1 181 153 | 1/1985 | Canada . |
| 0 738 904 | 10/1996 | European Pat. Off. . |
| 9-320336 | 12/1997 | Japan . |
| WO 94/13022 | 6/1994 | WIPO . |

*Primary Examiner*—Sandra O'Shea
*Assistant Examiner*—Hargobind S. Sawhney
*Attorney, Agent, or Firm*—Oblon, Spivak, McClelland, Maier & Neustadt, P.C.

[57] ABSTRACT

An emergency lighting fixture, particularly suited for industrial environments, includes a central body, at least one source of light constituted by an incandescent halogen lamp held inside a parabolic reflector and a transparent shell covering the fixture's central body. The reflector is adjustable by an operator from outside the emergency lighting fixture, after lifting the transparent shell, so as to regulate the direction of the light beam. Each reflector is further associated with a laser light source, capable of providing an emergency lighting system, for instance in the presence of smoke in the surrounding environment as detected by a smoke sensor. A regulating device of the laser light beam includes a ring nut swiveling in a horizontal plane and a plate for vertical adjustments, so as to make it possible to position the laser beam within pre-established angles.

28 Claims, 10 Drawing Sheets

EMERGENCY LIGHTING FIXTURE, ESPECIALLY FOR INDUSTRIAL ENVIRONMENTS

BACKGROUND OF THE INVENTION

1. Field of the Invention

This invention refers to an emergency lighting fixture, especially suitable for an installation in industrial environments.

2. Discussion of the Background

Fluorescent and incandescent lamps are currently known destined for the emergency lighting of workplaces and/or exits from working premises.

Industrial environments have a particularly strong demand for the supply, under emergency conditions, of a light beam of intensive lighting power and concentration in restricted areas (workplaces, escape routes, high risk areas).

The latest regulations on the subject matter in fact contain new directives relating to working safety, by imposing specific new requirements, aimed at protecting the safety and health of the workers at the workplace.

In particular, the regulations prescribe high intensity lighting under emergency conditions, such as network power outages, dangerous situations or the onset of fires; the recommended lighting levels at industrial installations of some height, up to 7 meters, is given by a value, measured with respect to a reference plane, of not less than 10% of the ordinary lighting standard, with an absolute minimum value of 15 lux.

This minimum lighting standard is produced by fixtures comprising a multiple number of incandescent lamps projecting a concentrated, downward directed beam; the lamps are occasionally contained in parabolic reflectors serving the purpose of more effectively concentrating and focusing the light beam.

However, especially where an emergency situation arises due to the onset of a fire or a short circuit, the smoke evolving from the source point of the fire almost immediately envelops the entire working area, thus voiding the purpose the emergency light was designed for; after a few seconds, the lighting from an incandescent light source becomes in fact inadequate, due to the fact that the light beam, even if extremely focused, no longer manages to penetrate the thickening smoke barrier.

SUMMARY OF THE INVENTION

The scope of this invention is therefore to outline an emergency lighting fixture, especially for industrial environments, suitable for eliminating the mentioned shortcomings, meaning capable of achieving an emergency lighting fixture to obtain a high lighting intensity at a ground level in workplaces and along escape routes, and such as to furnish, even in the presence of smoke, a lighting guide to point the personnel toward an escape route and/or safety exit.

A further scope of this invention is that of outlining an emergency lighting fixture, especially for industrial environments, capable of fitting the safety regulations listed in the existing directives.

A further scope of the invention is that of achieving an emergency lighting fixture, especially for industrial environments, allowing to easily direct the lighting beam toward one or more pre-established directions.

A further scope of this invention is that of outlining an emergency lighting fixture, especially for industrial environments, capable of being easily and economically built, without resorting to expensive materials and/or complex technologies.

These and other purposes are achieved by an emergency lighting fixture, especially for industrial environments, in accordance with claim 1, referred to for brevity.

In an advantageous manner, the fixture of this invention comprises a central body and two halogen lamps of an incandescent type, each held within a parabolic reflector. A transparent shell covers the central body of the fixture.

Moreover, each reflector may be swiveled by an operator from the outside, after lifting the transparent cover, so as to adjust the direction of the light beam.

Finally, the inside of the container associated with each reflector is fitted with a laser diode capable of providing a lighting guide to direct the personnel toward escape routes and/or safety exits, even where the environment is contaminated by smoke due to the onset of a fire.

The emission of a laser beam occurs automatically at the command of a signaling unit, and comprises a device detecting the presence of smoke in the environment.

The signaling unit can be fitted inside a normal flush-mounted box for electrical equipment, for instance one with three or six compartments.

The loosening a special screw of a tamper-proof type, fitted on the front face of the emergency lighting fixture according to this invention, allows turning a ring nut in such a way as to regulate the direction of the laser beam on a horizontal plane inside a pre-established angular sector, while the shifting of a plate, likewise positioned on the fixture's front face, allows regulating the laser emission in a vertical plane, so as to attain any position within a pre-established angle.

The maximum value of this angle equals 15 degrees with respect to a horizontal direction parallel to the front face of the fixture.

In this case, it can for instance be estimated that at a distance of 7 meters the laser beam deviates from the horizontal by about 2 meters.

BRIEF DESCRIPTION OF THE DRAWING

Further scopes and advantages of this invention will become apparent from the description and associated drawings to follow, supplied as a purely illustrative and non-limiting example, in which.

Figure 1:
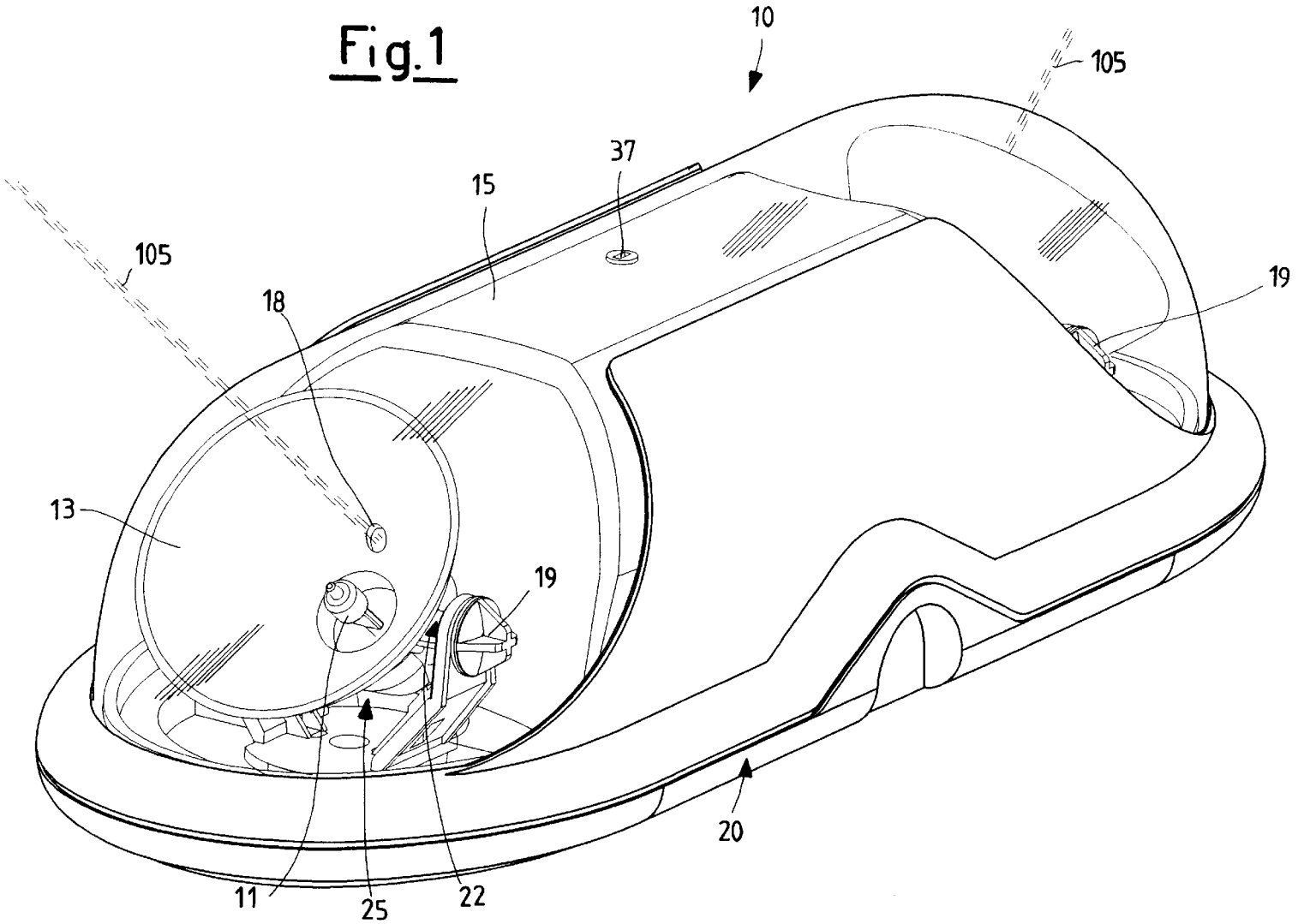
FIG. 1 represents a prospective view of a first embodiment of an emergency lighting fixture, especially for industrial environments, according to this invention.
Figure 2:
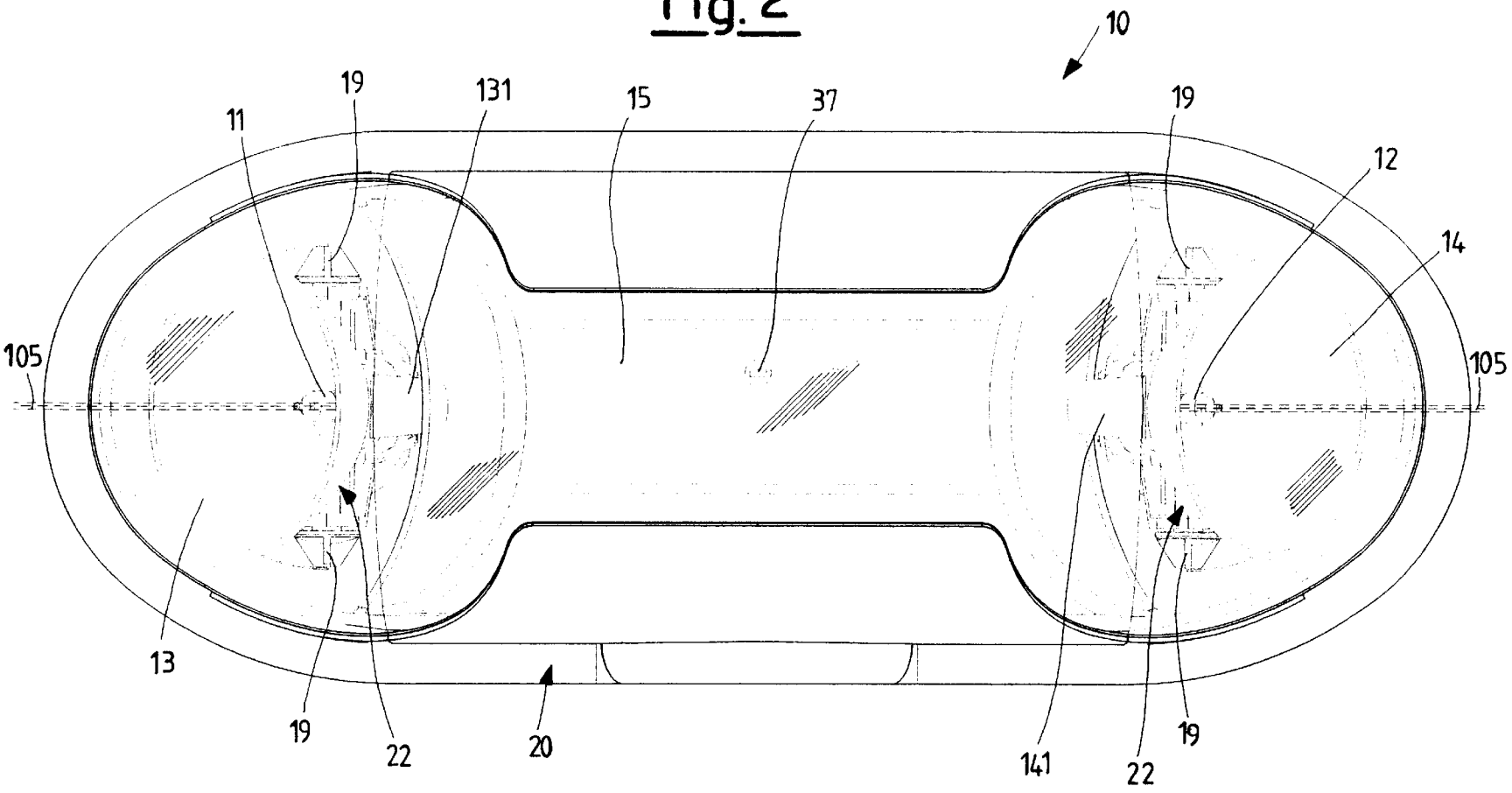
FIG. 2 is a plan view of the emergency lighting fixture shown in FIG. 1, according to this invention.
Figure 3:
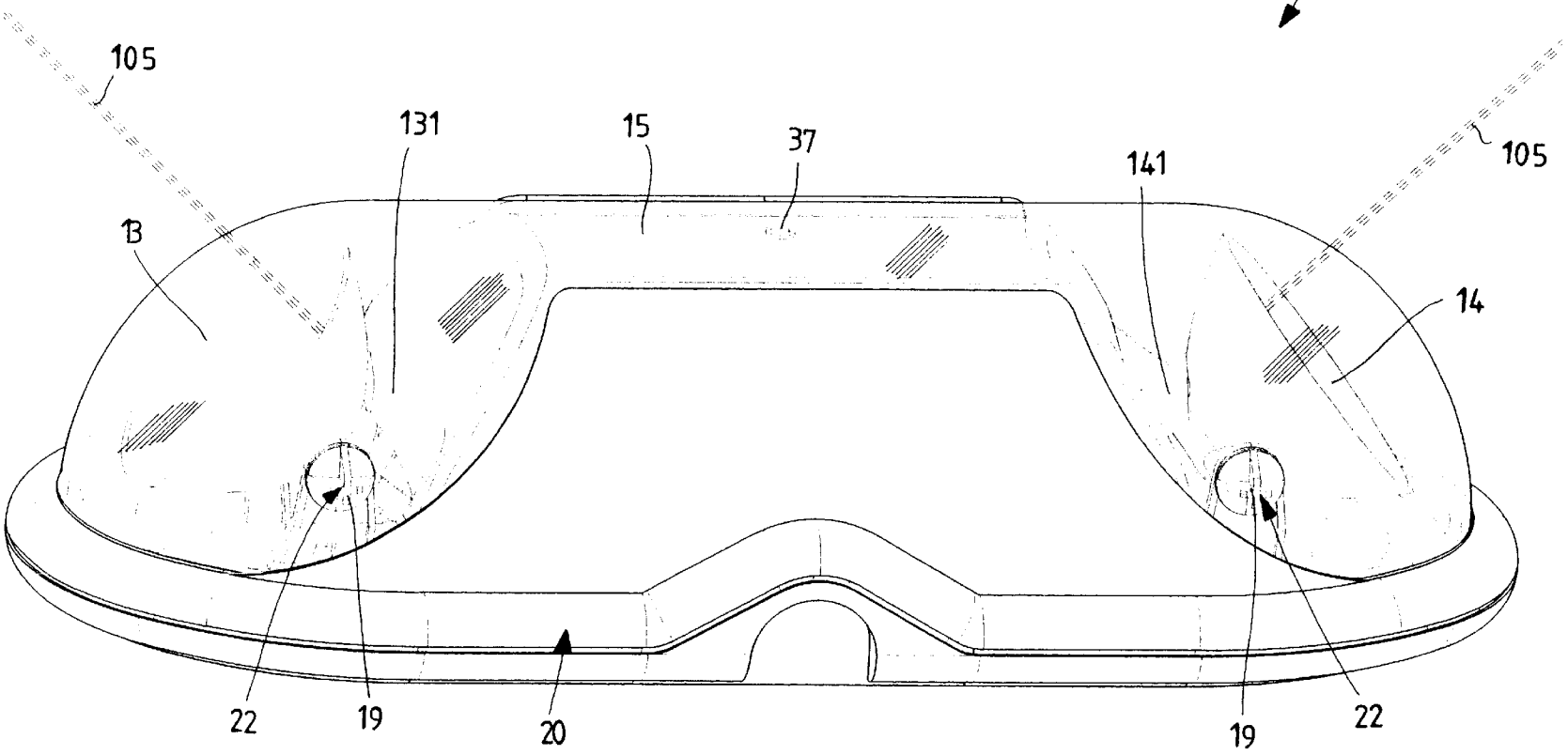
FIG. 3 is a top view of the emergency lighting fixture shown in FIG. 1, according to this invention.

With reference to the mentioned figures, the number 10 generally indicates an emergency lighting fixture, especially for industrial environments according to this invention, 20 indicates the central body of an elongated shape typically constructed of a plastic material of the fixture 10, and 15 indicates a transparent shell acting as a shield for the luminescent radiation emitted by two incandescent light sources (for instance, two halogen lamps) indicated by 11 and 12, while 13 and 14 are two swiveling parabolic reflectors, placed at the ends of the body 20 and containing the lamps 11 and 12 opposite their focus points.

37 indicates a LED diode signaling the lighted condition of the fixture 10, 18 and 18A indicate two holes set into the reflectors 13 and 14, respectively, passing electromagnetic rays (described in a simplified manner in the drawings by dashed parallel lines) emitted by two laser diodes 17 and 17A;19 indicates two knobs, one for each reflector 13 and 14, suitable for adjusting the exit direction of the light ray produced by the lamps 11, 12 and the radiation emitted by the laser diodes 17 and 17A.

Moreover, 22 indicates a general transmission mechanism of the motion produced by the knob 19 on the reflectors 13 and 14, which are attached to the central body 20 of the fixture 10 by a supporting structure identified as an overall unit by 25.

The inside of the body 20 holds an electrical signal conditioning circuit which includes the transformers 27, the power transistors 28, a terminal block 29 and the accumulator batteries 30.

The inside of each of the containers, marked by 131 and 141 and attached to the reflectors 13 and 14, respectively, holds the laser diodes 17, 17A and the electronic circuits to transfer the electric signal to the laser diodes 17, 17A, indicated as a whole by 35.

Figure 4:
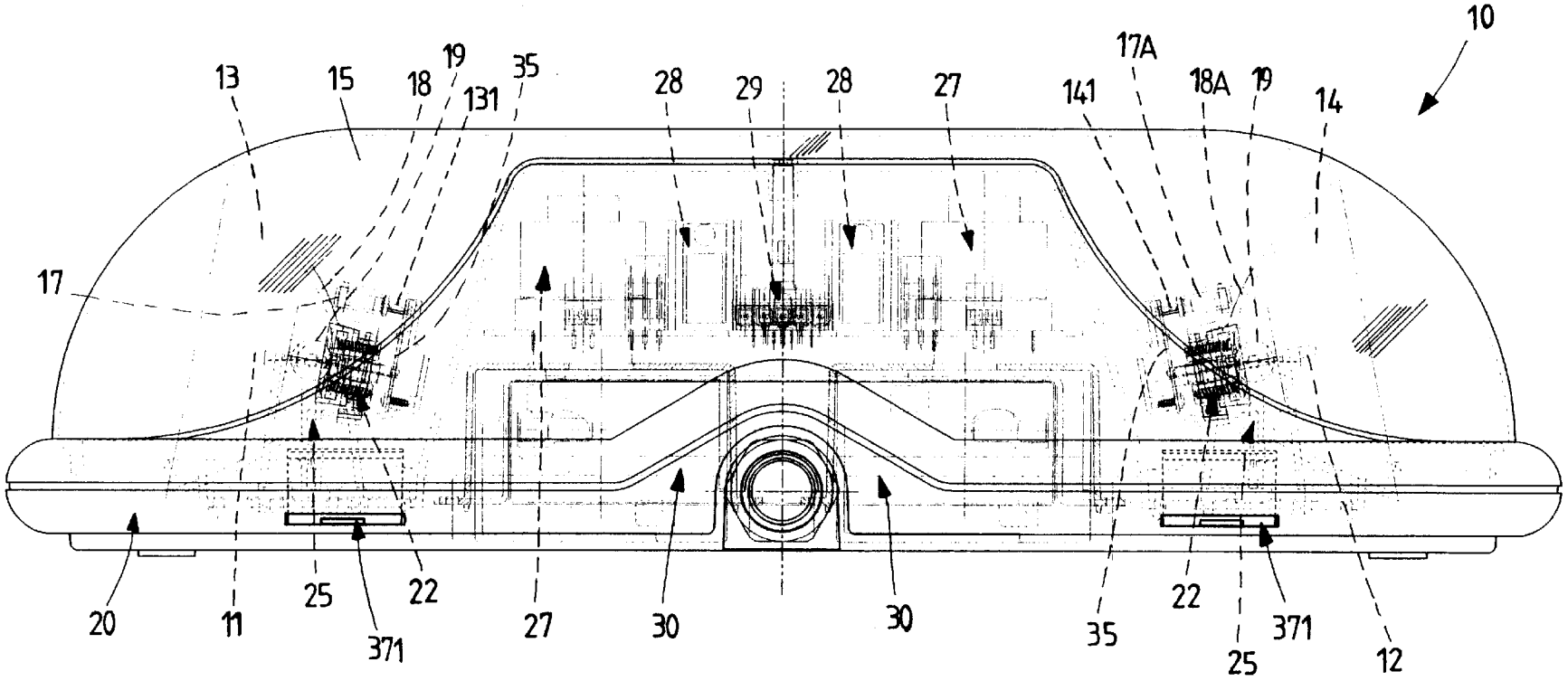
FIG. 4 is a side view of the emergency lighting fixture shown in FIG. 1, according to this invention.
Figure 5:
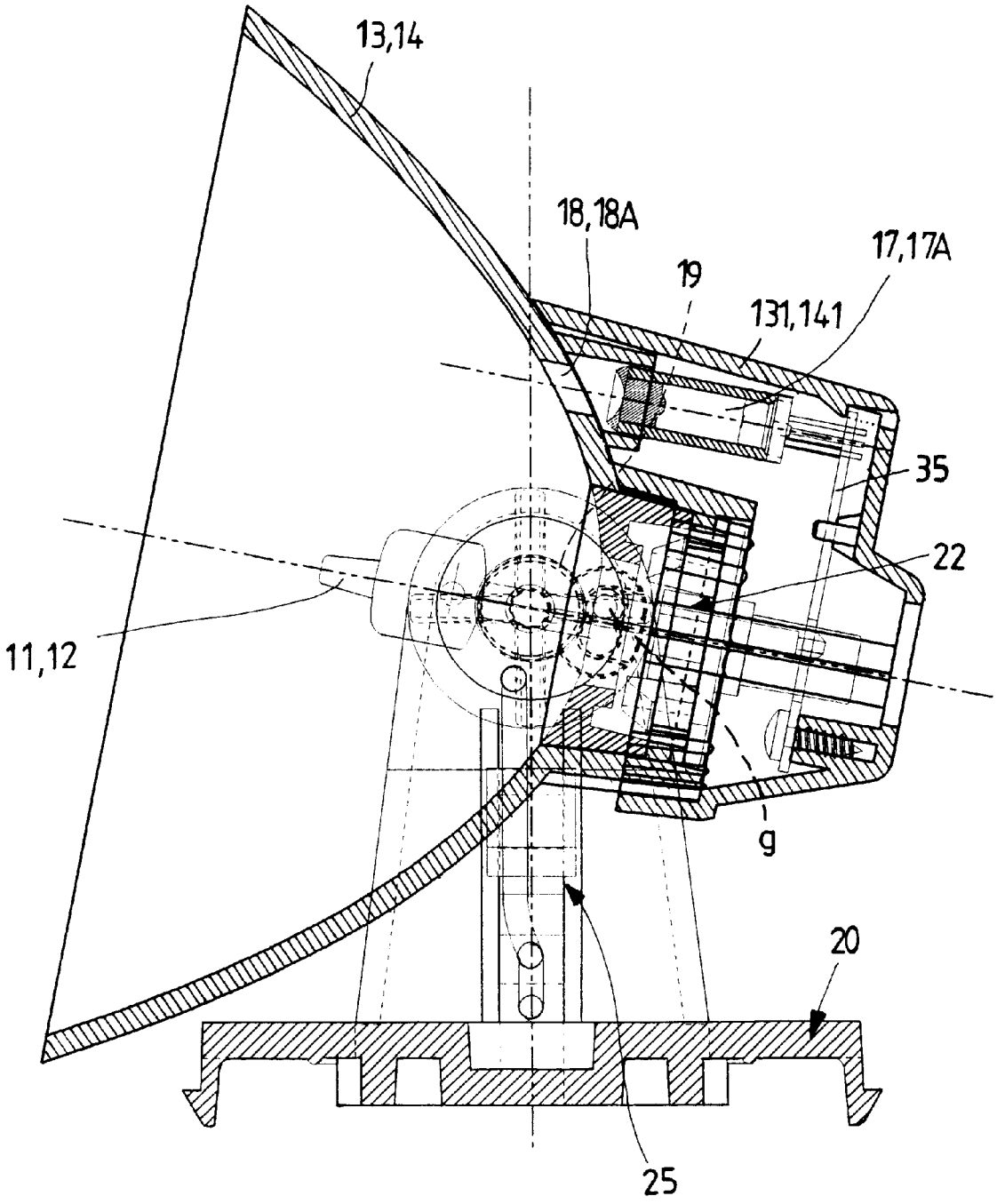
FIG. 5 shows an enlarged detail of the emergency lighting fixture shown in FIG. 1, according to this invention.
Figure 6:
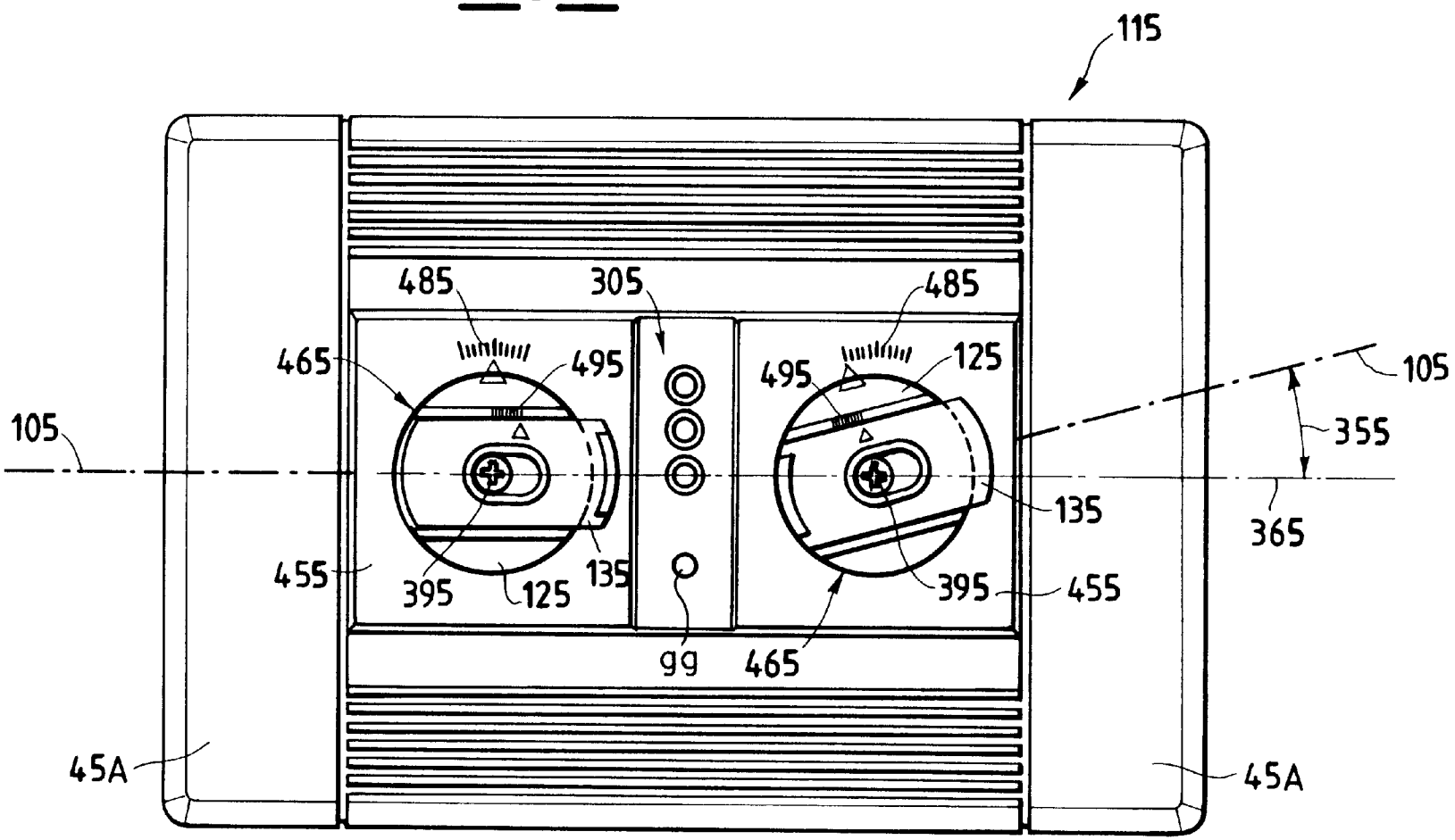
FIG. 6 represents a front view of a second embodiment of the emergency lighting fixture, especially for industrial environments, according to this invention.

Upon removing the transparent shell 15 and acting on four lateral hooks (two of which are shown by 371 in the FIG. 4), free access is gained to the reflectors 13, 14, so as to reach the lamps 11, 12 for their replacement or maintenance.

The installer may thus arrange the fixture 10 in the desired area of an industrial environment, remove the shell 15 and carry out the necessary operations before replacing the plastic cover. The same installer has the possibility, after removing the shell 15, of accessing the knobs 19 as needed to orient the reflectors 13, 14 at will and independently from each other, and thereby orient the directions of the light beams emitted by the lamps 11, 12, as well as the electromagnetic radiations emitted by the laser diodes 17, 17A.

In particular, in a preferred embodiment, the direction of light beams may be varied within a range of angular values from 0 to 90 degrees (including the extreme values), with respect to an imaginary longitudinal axis passing through the fixture's 10 center of gravity.

After completing the mechanical and electrical installation of the lighting fixture 10 and orienting the reflectors 13, 14, it therefore suffices to replace the shell 15 on the transparent body 20, before placing the fixture in a "stand-by" mode, ready to start operating as soon as an emergency occurs.

For this particular application, a laser diode with a MQW structure may be employed; for instance, a laser diode of a type HL6724MG, emitting a visible light (at a typical wavelength of 670 nm), at an optical outlet power of 5 mW, a typical operating current level of 35 mA, a threshold current value of 25 mA and a maximum operating voltage of 2.7 volt; the resulting light beam shows a maximum angular divergence of 11 degrees in a direction parallel to the direction of diffusion of the beam and of 40 degrees in a direction perpendicular to the direction of diffusion of the beam.

In a second form of embodiment shown as a non-limiting example of this invention, the emergency lighting fixture for industrial environments is indicated as an overall unit by 115, 455 indicates a frontal raceway of the fixture 115, preferably made of plastic material, 465 generically indicates two regulating devices for the same number of laser light beams, schematically shown by 105 and irradiated by the fixture 115, while 45A generically indicates a supporting frame and 305 shows a face dial holding a device capable of sensing the presence of smoke in the environment.

355 indicates the angle the laser beam 105 forms with the axis of symmetry, shown by 365, of the fixture 115, which lies in the middle of the raceway 455 and is arranged opposite the laser radiating sources, which are considered as point sources for simplicity and whose position is indicated by the reference 375. This angle, as measured beginning from the axis 365, falls within a range of +15/−15 degrees; all of these values can be reached continuously by the laser beam 105.

On the other hand, 35A indicates the angle formed by the laser beam 105 with the outline, shown by 205, of a plane perpendicular to the plane identified by the outline indicated by 145 and passing through the laser light source 375.

This angle, measured from the outline 205, falls within the range of 0/+15 degrees; all the values of this range may be reached continuously by the laser beam 105.

For instance, each laser source 375 constituted by a laser diode is contained within a respective fixture emitting an electromagnetic radiation, generally indicated by the reference 385, and the beam 105 is irradiated into the environment through an opening 595 of the containing structure 605 of the entire lighting fixture 115.

The regulating devices 465 of the laser beams 105 are preferably provided in two units and arranged in parallel on the raceway 455.

Figure 7:
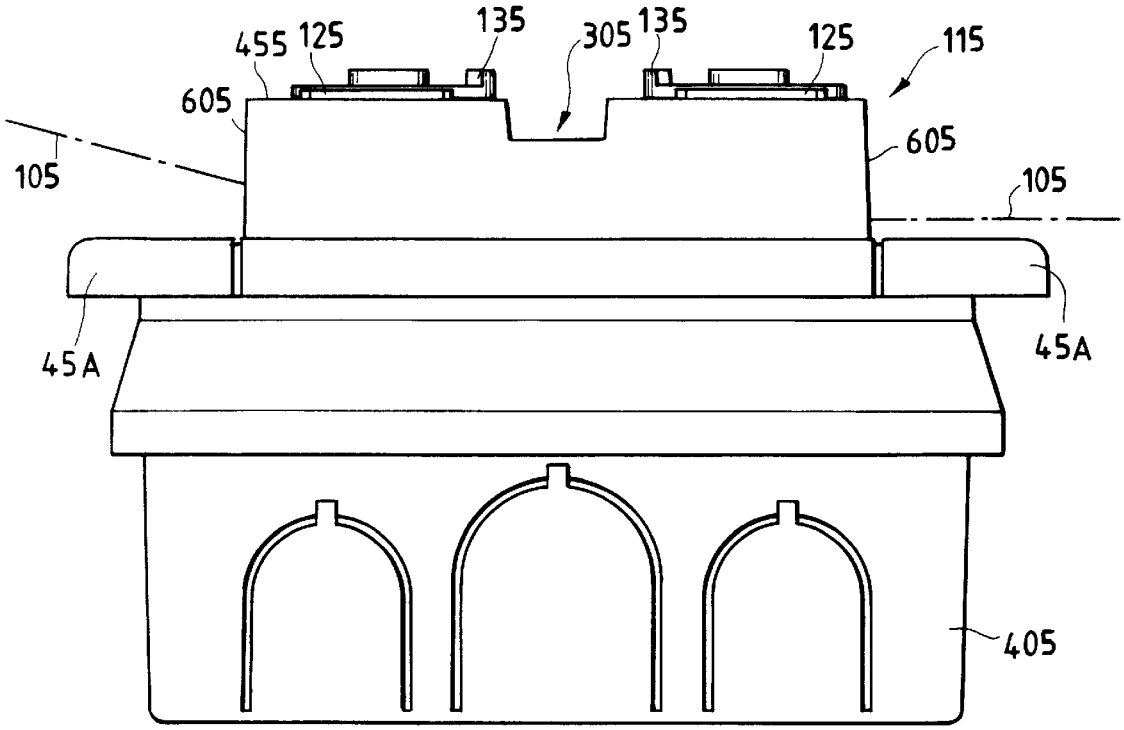
FIG. 7 is a first side view of the emergency lighting fixture shown in FIG. 6, according to this invention.
Figure 8:
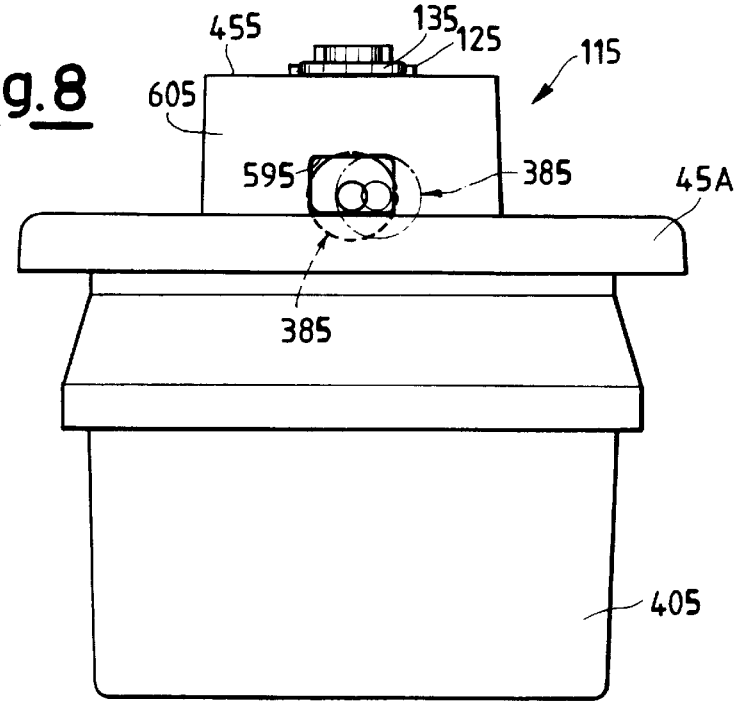
FIG. 8 is a second side view of the emergency lighting fixture shown in FIG. 6, according to this invention.
Figure 9:
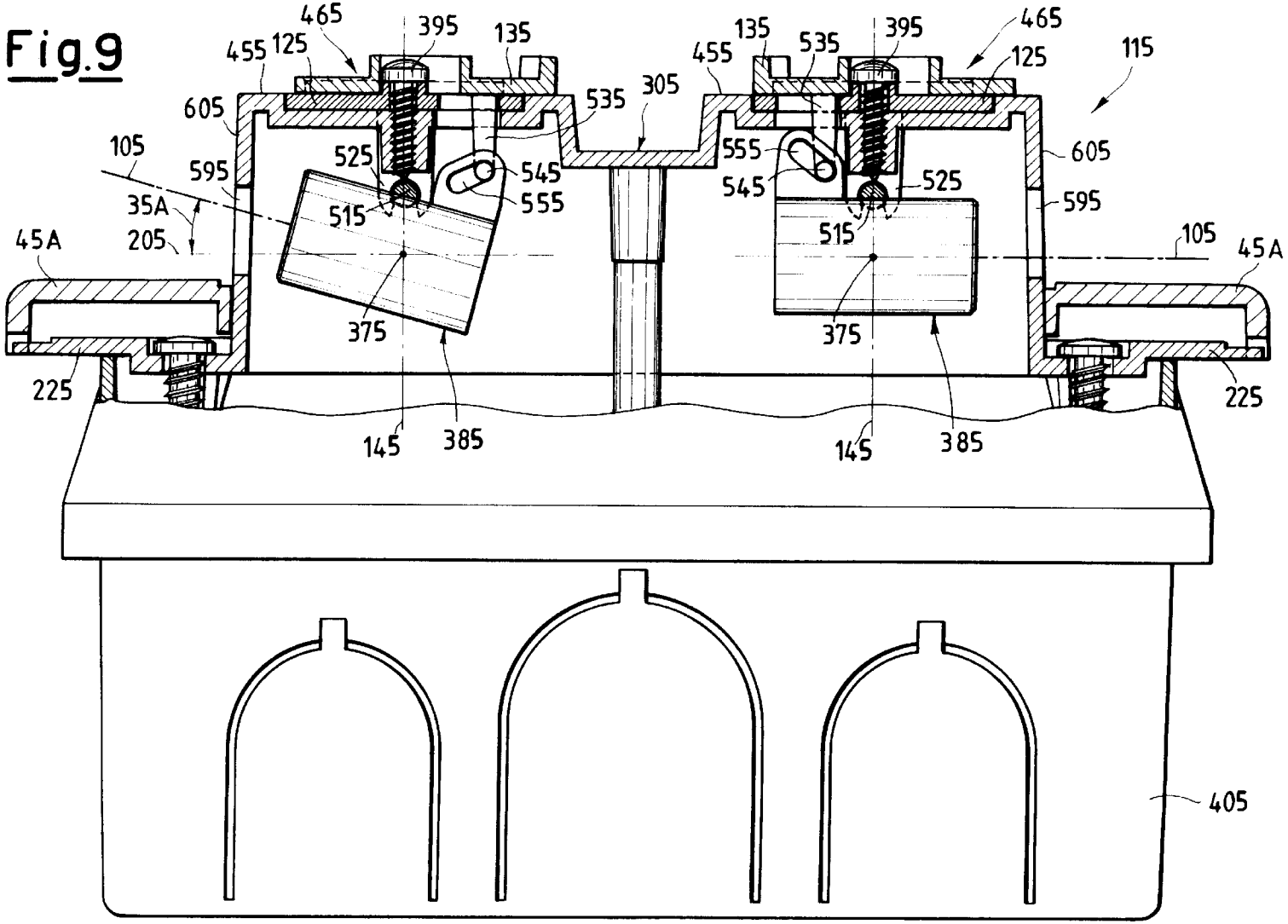
FIG. 9 is a split and partially sectionalized side view of the fixture shown in FIG. 6, showing two adjusting devices for the irradiated laser beam.
Figure 10:
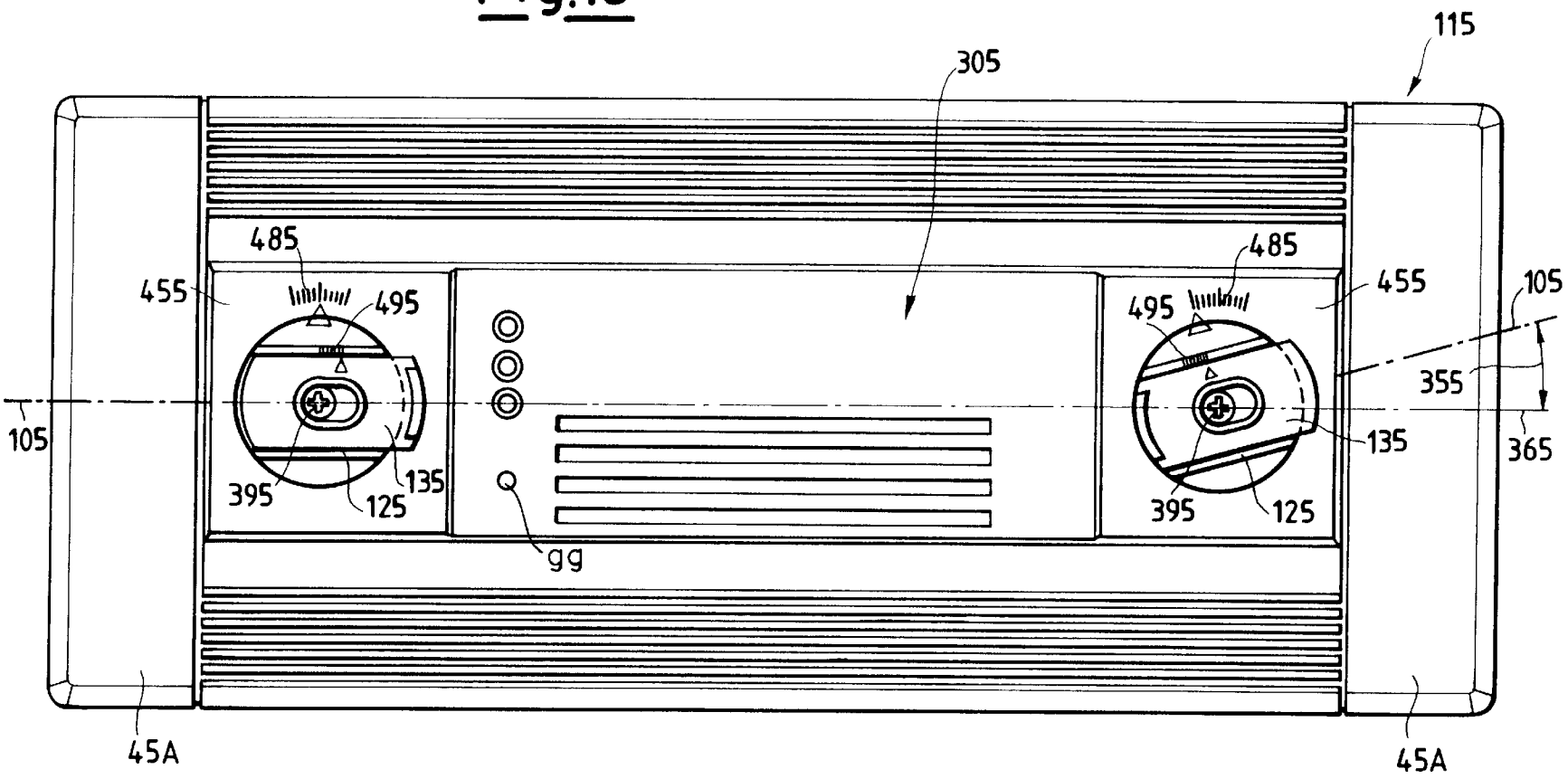
FIG. 10 is a front view of a third embodiment of an emergency lighting fixture, especially for industrial environments, according to this invention.
Figure 11:
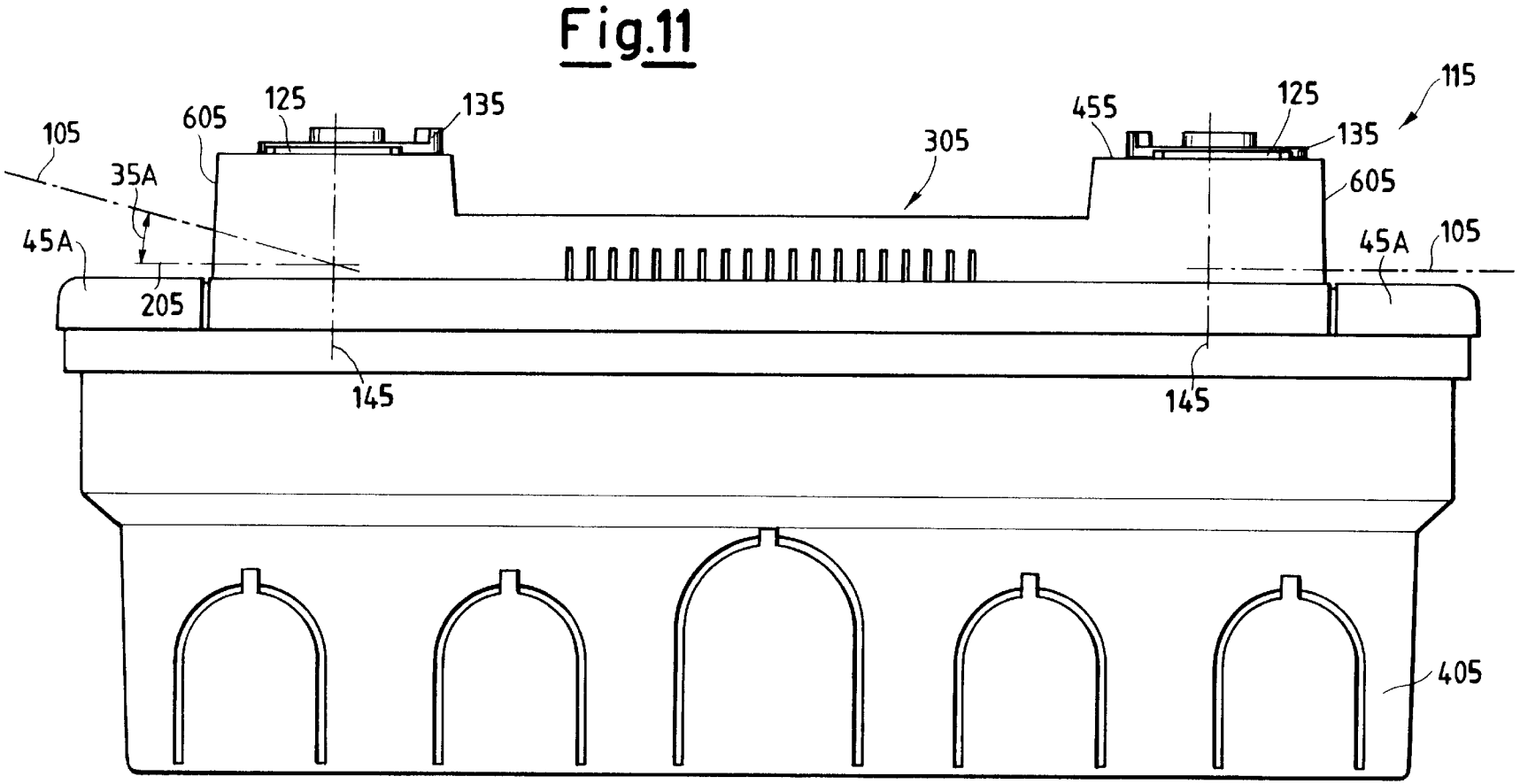
FIG. 11 is a first side view of the emergency lighting fixture shown in FIG. 10.

225 indicates a plane at the point of installation of the fixture 115, which is embedded in a normal flush-mounted box for electrical installations as indicated by 405, at three compartments as shown in the FIGS. 7,8 and 9 or at 6 compartments as shown in FIG. 11 and destined to hold one or more units for signaling the presence of smoke and/or for guiding the emission of the laser radiation.

Referring in particular to the FIG. 9, 395 indicates a special tamper-proof screw mounted coaxially along the raceway 145 with each emission source 375, which permits adjusting the directions of emission of a laser fixture 385, 125 indicates a circular ring nut equipped with a special needle indicator 485 to adjust the direction of the beam 105 in a horizontal sense according to the angle 355, while 135 indicates a plate for regulating the direction of the laser beam 105 in a vertical sense, according to the angle 35A, equipped with a special needle indicator 495.

In case of an emergency in an industrial environment, such as a short circuit, an electrical power outage or the onset of a fire, the traditional emergency lighting fixtures are switched on.

It can be planned that in case of the presence of smoke in the environment a sensing device 9,99 contained inside the fixture 115 transfers the signal to a signaling unit, not shown, set into the flush-mounted box 405, which in turn commands the lighting of the laser fixture 385.

It is possible, by loosening a screw 395 with a special tool, to adjust the direction of the laser beam 105 both horizontally, according to a plane parallel to the installation surface 225, and vertically according to a plane perpendicular to the mentioned plane.

A rotation of the ring nut 125 allows adjusting the beam 105 in a horizontal sense, within a range of angular values from +15 to −15 degrees.

The desired measure may be set up in such a manner that the needle on the indicator 485 points to the angular value chosen.

This adjustment is made possible by the fact that the ring nut 125 forms a fixed unit with a U-shaped attachment, indicated by 525, in contact with a pin 515 of the laser fixture 385, which allows rotating the fixture 385 on the plane identified by the raceway 205.

The special screw 395, known in itself, has a hexagonal cavity and facilitates the assembly between the ring nut 125 and the plate 135 of the lighting fixture 115, thanks to its heavy tightening coefficients and low axial loads.

The geometric structure of the cavity is such as to require only a minimum pressure to hold the screwdriver in constant contact with the same; the screwing tool is therefore exposed to a low degree of wear.

The screw 395 is further equipped with an anti-breaking and cutting peg for a combination-type screwdriver.

The plate 135 designed for a vertical adjustment is connected with a pin shown by 535, which holds a peg 545 engaging with an eyelet 555, built in a single piece with the laser fixture 385, opposite one of the extremities.

Each horizontal motion of the plate 135 corresponds to a shift of the peg 545 inside the eyelet 555, forcing the fixture 385 to rotate and therefore to direct the laser beam 105 upward, as a result of a force exerted from the top downward, near an extremity.

The angle 35A formed by the laser beam 105 with the raceway 205 can be adjusted from the outside by the user, by shifting the plate 135 in a horizontal sense, until the needle of the indicator 495 comes to face the desired angular value, ranging between 0 and 15 degrees.

The above description clarifies the characteristics of the emergency lighting fixture, especially for industrial environments, which is the object of this invention, as well as its resulting advantages.

In particular, these are represented by:

Flexibility, simplicity and speed of installation and wiring of the fixture;

Conformity with the national and international directives in terms of their safety in industrial environments and of working hygiene;

Adequate lighting of the workplaces and escape routes of industrial environments in emergency situations, thanks to the fact that they exploit a focused laser source as a light beam, capable of penetrating even thick smoke;

A possibility of regulating the direction of the fixture's laser beam from the outside, both in a horizontal and in a vertical sense, so as to be able to always point it in a convenient manner, even in case of a relocation of the inlet and/or outlet routes or in case of an installation in a different environment;

A possibility of embedding the fixture in normal flush-mounted boxes for electrical installations;

An automatic lighting of the laser fixture in case of a presence of smoke in the surrounding environment;

A limited cost with respect to the known technology.

It is obvious that numerous other modifications can be applied to the emergency lighting fixture, especially for industrial environments, as an object of this invention, without however abandoning the innovative principles inherent in the inventive concept. It is equally obvious that in the practical execution of the invention, the materials, shapes and sizes of the details shown may be of any kind according to demand, and that the same may be substituted with other technical equivalents.

In particular, the subject fixture may be applied to walls or ceilings, even from considerable heights, in particular up to 7 m, so that the light beams emitted by the sources placed at the extremities of the fixtures can be directed into the environment at will.

What is claimed is:

1. An emergency lighting fixture, comprising:

a central body of an elongated shape;

a transparent cover shell functioning as a diffusing shield for visible electromagnetic rays emitted by at least one light source fitted inside at least one parabolic reflector placed in said central body inside said transparent cover shell, wherein said light source includes at least one laser source; and a smoke sensing device, wherein emission by said at least one laser source is controlled by an output of said smoke sensing device.

2. A fixture according to claim 1, wherein said smoke sensing device is positioned within said emergency lighting fixture.

3. A fixture according to claim 1, wherein said at least one parabolic reflector is configured to be manually swivelled.

4. A fixture according to claim 3, wherein said at least one parabolic reflector is configured to be swivelled by acting on at least one knob by a transmission system attached to a supporting structure of the parabolic reflector on the central body.

5. A fixture according to claim 1, wherein said at least one light source includes two light sources each fitted in a parabolic reflector and each constituted by a halogen lamp of an incandescent type and a laser source.

6. A fixture according to claim 1, wherein said at least one laser source is constituted by a laser diode.

7. A fixture according to claim 1, wherein said at least one parabolic reflector include two parabolic reflectors.

8. A fixture according to claim 1, wherein said at least one parabolic reflector has at least one hole configured to pass the visible electromagnetic radiation emitted by said at least one light source.

9. A fixture according to claim 1, wherein said at least one laser source is inserted inside at least one container attached to said at least one parabolic reflector.

10. A fixture according to claim 9, wherein an inside of said container holds at least one of electrical and electronic circuits for conditioning and transmitting an electrical signal to said at least one laser source.

11. A fixture according to claim 1, wherein an inside of said central body holds electrical signal feeding and conditioning circuits, including at least one terminal block, a multiple number of transistors, at least two electrical transformers, and at least two electrical energy accumulator batteries.

12. A fixture according to claim 1, further comprising at least one structure configured to emit a laser beam from said at least one laser source through at least one opening in said at least one structure, on the part of said at least one laser source, of at least one means for adjusting at least one direction of said laser beam according to at least one of a first plane parallel to a surface on which said at least one structure is installed for emergency lighting and a further plane perpendicular to said first plane so that directions reached by said laser beam form, with at least one pre-established reference direction, an angle within a predetermined angular range.

13. A fixture according to claim 12, wherein said angle can be adjusted by using at least one needle indicator.

14. A fixture according to claim 12, further comprising:

at least one ring nut configured to be rotated to adjust the direction of said laser beam in accordance with the said first plane, whereby said first plane is constituted by a horizontal plane parallel to a surface on which said emergency lighting fixture is installed; and at least one plate configured to regulate the direction of the laser beam according to a vertical plane perpendicular to said horizontal plane, in such a manner that the directions reached by the said laser beam on said horizontal plane form, with at least one predetermined reference direction, an angle within an angular range of +15/−15 degrees, inclusive.

15. A fixture according to claim 14, wherein said directions of the laser beam reachable according to said vertical plane form, with at least one pre-established reference direction, an angle included within an angular range of 0/+15 degrees, inclusive.

16. A fixture according to claim 15, wherein at least one of said horizontal plane and said vertical plane comprise said at least one laser source.

17. A fixture according to claim 14, wherein said at least one ring nut forms a single piece with at least one attachment in contact with at least one pin provided on said at least one structure for emission of the laser beam.

18. A fixture according to claim 14, wherein said at least one plate is connected with at least one pin carrying a peg engaging with an eyelet, arranged opposite one of extreme ends of said at least one structure for emission of the laser beam.

19. A fixture according to claim 14, wherein said at least one ring nut and said at least one plate are connected to each other by at least one supporting screw, which blocks its movement if completely turned in.

20. A fixture according to claim 19, wherein said screw has a hexagonal cavity and is configured to facilitate assembly of said at least one ring nut with said at least one plate.

21. A fixture according to claim 1, wherein the emergency lighting fixture is embedded in flush-mounted boxes for electrical installations.

22. A fixture according to claim 21, wherein the flush-mounted boxes include one of three and six compartments.

23. A fixture according to claim 1, wherein emission of a laser beam from said at least one laser source occurs at a command of at least one signaling unit contained inside a flush-mounted box including one of three and six compartments.

24. An emergency lighting fixture, comprising:

a central body of an elongated shape;

a transparent cover shell functioning as a diffusing shield for visible electromagnetic rays emitted by at least one light source fitted inside at least one parabolic reflector placed in said central body inside said transparent cover shell, wherein said light source includes at least one laser source; and wherein said at least one parabolic reflector is configured to be manually swivelled by acting on at least one knob by a transmission system attached to a supporting structure of the parabolic reflector on the central body.

25. An emergency lighting fixture, comprising:

a central body of an elongated shape;

a transparent cover shell functioning as a diffusing shield for visible electromagnetic rays emitted by at least one light source fitted inside at least one parabolic reflector placed in said central body inside said transparent cover shell, wherein said light source includes at least one laser source; and wherein an inside of said central body holds electrical signal feeding and conditioning circuits, including at least one terminal block, a multiple number of transistors, at least two electrical transformers, and at least two electrical energy accumulator batteries.

26. An emergency lighting fixture, comprising:

a central body of an elongated shape;

a transparent cover shell functioning as a diffusing shield for visible electromagnetic rays emitted by at least one light source fitted inside at least one parabolic reflector placed in said central body inside said transparent cover shell, wherein said light source includes at least one laser source; and wherein said at least one laser source is inserted inside at least one container attached to said at least one parabolic reflector, and wherein an inside of said container holds at least one of electrical and electronic circuits for conditioning and transmitting an electrical signal to said at least one laser source.

27. An emergency lighting fixture, comprising:

a central body of an elongated shape;

a transparent cover shell functioning as a diffusing shield for visible electromagnetic rays emitted by at least one light source fitted inside at least one parabolic reflector placed in said central body inside said transparent cover shell, wherein said light source includes at least one laser source; and at least one structure configured to emit a laser beam from said at least one laser source through at least one opening in said at least one structure, on the part of said at least one laser source, of at least one means for adjusting at least one direction of said laser beam according to at least one of a first plane parallel to a surface on which said at least one structure is installed for emergency lighting and a further plane perpendicular to said first plane so that directions reached by said laser beam form, with at least one predetermined reference direction, an angle within a predetermined angular range.

28. An emergency lighting fixture, comprising:

a central body of an elongated shape;

a transparent cover shell functioning as a diffusing shield for visible electromagnetic rays emitted by at least one light source fitted inside at least one parabolic reflector placed in said central body inside said transparent cover shell, wherein said light source includes at least one laser source; and wherein the emergency lighting fixture is embedded in flush-mounted boxes for electrical installations.

* * * * *